United States Patent [19]

Choy et al.

[11] Patent Number: 4,759,867

[45] Date of Patent: Jul. 26, 1988

[54] HARD SURFACE ACID CLEANER

[75] Inventor: Clement Kin-Man Choy, Walnut Creek, Calif.; Ellen E. Valachovic, Corvallis, Ore.

[73] Assignee: The Clorox Company, Oakland, Calif.

[21] Appl. No.: 59,131

[22] Filed: Jun. 3, 1987

Related U.S. Application Data

[63] Continuation of Ser. No. 512,100, Jul. 7, 1983, abandoned.

[51] Int. Cl.[4] ..... C11D 3/34

[52] U.S. Cl. ..... 252/143; 252/106; 252/142; 252/173; 252/174.17; 252/547; 252/549; 252/556; 252/558; 252/DIG. 14; 134/3

[58] Field of Search ..... 252/142, 143, 145, 151, 252/173, 549, 556, 558, 559, DIG. 14, 528, 547, 106, 174.17; 134/3

[56] References Cited

U.S. PATENT DOCUMENTS

| | | | |
|---|---|---|---|
| 3,463,736 | 8/1969 | Reid et al. | 252/152 |
| 3,726,813 | 4/1973 | Borrello | 252/539 |
| 3,969,258 | 7/1976 | Carandang et al. | 252/142 |
| 3,969,282 | 7/1976 | Kappler et al. | 252/559 |
| 4,011,097 | 3/1977 | Sharp | 252/143 |
| 4,414,035 | 11/1983 | Newberry et al. | 134/3 |

FOREIGN PATENT DOCUMENTS

| | | |
|---|---|---|
| 2,050,560 | 4/1971 | Fed. Rep. of Germany . |
| 2919666 | 11/1979 | Fed. Rep. of Germany . |
| 778903 | 5/1953 | United Kingdom . |

*Primary Examiner*—Paul Lieberman
*Assistant Examiner*—Hoa Van Le
*Attorney, Agent, or Firm*—Joel J. Hayashida; Stephen M. Westbrook

[57] ABSTRACT

Hard surface acid cleaners providing surprisingly fast acting and effective cleaning results across a wide variety of problematic cleaning areas, and methods for making the same are made by combining alkyl aryl sulfonic acids and water.

The preferred alkyl aryl sulfonic acids are alkyl benzene sulfonic acids of the general structure

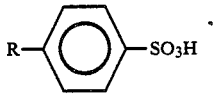

wherein R is alkyl averaging 5 to 20 carbon atoms in length.

Additionally, solvents, antimicrobial compounds, defoamers, thickeners and other cleaning adjuvants may be added to these hard surface acid cleaners.

4 Claims, No Drawings

HARD SURFACE ACID CLEANER

This is a continuation of co-pending application Ser. No. 512,100 filed on July 7, 1983, now abandoned.

There are many examples of hard surface cleaners in the art, containing some sort of anionic surfactant, solvent, perhaps a dye and a fragrance to impart a pleasing color and odor, and mostly water. Most of these prior art cleaners suffer from one or more disadvantages. For example, some cleaners are effective only on hard water stains. An example of this class of cleaner is a highly acidic toilet bowl cleaner containing hydrochloric acid. Hard water stains are mineral stains caused by the deposition of calcium or magnesium salts present in hard water. Certain other cleaners may be effective only against soap scum stains, caused when a fatty acid soap, such as a sodium lauryl fatty acid soap precipitates in hard water containing alkaline earth metal salts, such as calcium, magnesium, or barium, causing the familiar soap scum stain. Still other cleaners may be effective only on greasy/oily stains. Generally speaking, these are cleaners which have either at least some water miscible solvent, and/or some higher amount of nonionic and/or anionic surfactants.

None of the prior art cleaners have addressed all three of these problematic areas together. As mentioned, a particular cleaner may be effective against a particular stain or cleaning problem, but not against the others. Thus, ineffective cleaning results may occur against certain stains using some of these cleaners, requiring purchase of other cleaners which will effectively remove the target stain. This will result in added expense as a particular cleaner must be purchased for a particular stain.

Furthermore, many of the prior art cleaners are very slow-acting. That is, after being applied to a target stain for long periods of time, they may show some cleaning effect, but this slow action is considered a great disadvantage and inconvenience.

Thus, heretofore no single cleaner has been formulated which will satisfactorily clean all three types of stains. There is also a need for an effective all purpose hard surface cleaner which is faster than the prior art cleaners. There is thus a long felt need for a multipurpose household cleaner capable of quickly and effectively cleaning all three types of stain.

Linear alkyl benzene sulfonic acid has been well known in the detergent and cleaner field as a storage compound which, upon neutralization with generally, an alkali metal salt, is available for use as an anionic surfactant. This was recognized in Kappler, et al, U.S. Pat. No. 3,969,282 which utilized alkyl benzene sulfonic acid in combination with a nonionic surfactant as a storage compound to be neutralized with alkali metal salts prior to using them to launder fabrics. Further, Reid, U.S. Pat. No. 3,463,736 showed that linear alkyl benezene sulfonic acids could be neutralized with triethanolamine to act as a cleaner. However, it was not realized in the art that linear alkyl benezene sulfonic acids can be utilized as hard surface cleaners themselves.

DISCLOSURE OF THE INVENTION

This invention relates to an improved, hard surface acid cleaner having a pH of no more than approximately 6.5 comprising:

(a) alkyl aryl sulfonic acid; and (b) at least 50.0% by weight water.

The preferred alkyl aryl sulfonic acid is a linear alkyl benzene sulfonic acid surfactant of the general structure

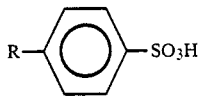

wherein R is an alkyl averaging 5 to 20 carbons.

In a further embodiment, this hard surface acid cleaner further comprises (c) a solvent selected from straight chain alkanols averaging 1 to 10 carbons, alicyclic alkanols averaging 5 to 10 carbons, dialkyl ethers averaging 2 to 8 carbons, and glycol ethers averaging 3 to 20 carbons, and mixtures thereof.

In yet another embodiment, the hard surface acid cleaner further comprises (d) an antimicrobial compound selected from:

(i) a substituted phenol of the general structure;

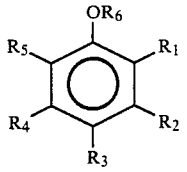

wherein $R_1$, $R_2$, $R_3$, $R_4$, and $R_5$ can separately be a phenyl group, Cl or H, and $R_6$ can be H or Na;

(ii) a quaternary ammonium compound; and (iii) mixtures thereof.

In yet another embodiment, the hard surface cleaner further comprises (e) a thickener selected from gums, polysaccharides and resins.

In still another embodiment, the hard surface acid cleaner further comprises (f) a defoamer selected from the dialkyl polysiloxane polymers.

The hard surface acid cleaner of this invention can also include at least one other cleaning adjuvant selected from dyes, pigments, fragrances, and builders.

Surprisingly, the hard surface acid cleaner of this invention has proven to be both effective and fast-acting against all three major problem stains, namely, (1) soap scums; (2) hard water stains; and (3) greasy oily stains.

DETAILED DESCRIPTION OF THE INVENTION

The present invention is a hard surface acid cleaner which has surprisingly effective and fast cleaning results on all three problem areas: (1) soap scums; (2) hard water stains; and (3) greasy/oily stains. The surprising revelation was that alkyl aryl sulfonic acid compounds, most specifically, linear alkyl benzene sulfonic acids, ("HLAS") were responsible for the improved cleaning in all three areas. These alkyl benezene sulfonic acid surfactants are not neutralized with alkali metal, alkaline earth metal, or ammonium salts as are the typical detergents using substituted alkyl benezene sulfonates.

The linear alkyl benzene sulfonic acids used in this invention are, as previously mentioned, commonly neutralized with sodium or other alkali metal salts to make common cleaners. Linear alkyl benzene sulfonic acid itself is produced by a two step synthesis, in which benzene is first alkylated with some alkyl chloride in the presence of catalyst. Next, the alkylated benzene is reacted with sulfonating reactant. A third step, which does not concern the present invention, can occur when the thus produced linear alkyl benzene sulfonic acid is neutralized with an alkali metal hydroxide, such as NaOH, to produce the sodium salt, which is commonly called "LAS."

Linear alkyl benzene sulfonic acid—which was introduced for heavy industrial use, after it was discovered that branched alkyl benzene sulfonate ("ABS") was significantly less bio-degradable—is produced by many companies, including Continental Oil Company under the brand name of Conoco SA-597, and Pilot Chemical Company under the brand name Calsoft LAS-99, Witco Chemical Corporation under the brand name of Witco 1298 Soft Acid and Stepan Chemical Company under the brand name of Bio Soft S-100.

Linear alkyl benzene sulfonic acid has the general structure

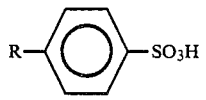

wherein R is alkyl averaging 5 to 20 carbon atoms. Most preferable for use in the formulas of this invention are dodecylbenzene sulfonic acids, wherein R averages about 11.4 carbon atoms in length.

Other alkyl aryl sulfonic acids suitable for use in this invention include alkylated diphenyl oxide disulfonates of the general structure

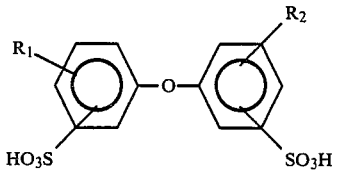

wherein $R_1$ is H and $R_2$ is alkyl, averaging 5 to 20 carbon atoms in length. When $R_1$ is alkyl, $R_2$ is H.

Preferably, a range of 0.001% to 50.0% particularly, 1.0% to 30.0% and most preferably 5.0% to 15% by weight of acid surfactant is present in compositions of this invention. Further, the preferred surfactant of this invention will cause the formulas of this invention to have pH's of no more than 6.5, and preferably, below 3.

An example of a suitable alkyl sulfonic acid is Dowfax 2AO manufactured by Dow Chemical Company corresponding to the structure immediately above when $R_1$ is H and $R_2$ averages 12 carbons.

SOLVENTS

In a further embodiment, solvents are added to the acid surfactants of this invention. Solvents appropriate for use in this invention include straight chain, primary, secondary and tertiary $C_{1-10}$ alkanols, $C_{5-10}$ alicyclic alcohols, $C_{2-8}$ dialkyl ethers, $C_{3-20}$ acyl and aryl glycol ethers and mixtures thereof.

1. Alkanols:

appropriate alkanol solvents in this invention have the general formula R-OH wherein R can be a straight, or substituted carbon chain of 1–10 carbon atoms. Solvents of this type include methanol, ethanol, n-propanol, isopropanol, n-butanol, sec butanol, tert butanol, hexanol, heptanol, etc.

2. Aliphatic Cyclic Alcohols (Alicylics):

Further appropriate solvents herein are ring structures such as cyclohexanol, cyclooctanol, cyclodecanol, etc. These alicyclics preferably average 5–10 carbon atoms in their ring structures.

3. Dialkyl ethers:

the dialkyl ethers suitable for use as solvents in this invention have a general structure R—O—$R_1$, wherein R and $R_1$ are equal, and each comprise a carbon chain of at least 1. Preferably, the dialkyl ethers herein comprise two to eight carbon atoms in average chain length. Examples of this particular group of solvents include dimethyl ether, diethyl ether, and dipropyl ether.

4. Glycol ethers:

particularly preferred as solvents in this invention are the glycol ethers having the general structure R—O—$R_1$—OH, wherein R is an alkoxy of 1 to 20 carbon atoms, or aryloxy of at least 6 carbon atoms, and $R_1$ is an ether condensate of propylene glycol and/or ethylene glycol having from one to ten glycol monomer units. Preferred are glycol ethers having one to five glycol monomer units. These are $C_{3-20}$ glycol ethers.

Examples of particularly preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol methyl ether, diethylene glycol ethyl ether, diethylene glycol butyl ether, ethylene glycol phenyl ether, and propylene glycol phenol ether.

These glycol ethers are especially preferred because they are colorless liquids with mild, pleasant odors. They are very miscible with water, and have been found to be especially stable with the acid surfactants noted above.

Addition of 0.001–25.0% by weight of any of the solvents disclosed in this hard surface acid cleaner appears desirable, and especially preferred is 0.1 to 15% by weight of added solvent. As will be further discussed in greater detail, addition of solvents to the hard surface acid cleaners herein provides surprisingly even greater cleaning benefits.

ANTIMICROBIAL COMPOUND

In yet another embodiment of this invention, antimicrobial compounds are added to the novel hard surface cleaners of this invention which are selected from substituted phenols and quaternary ammonium compounds.

1. Substituted phenols:

suitable antimicrobial compounds can be selected from the substituted phenols having the general structure

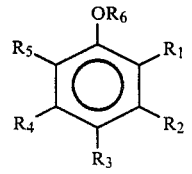

wherein $R_1$, $R_2$, $R_3$, $R_4$, and $R_5$ can be separately phenyl group, Cl, H, and the alkali metal salts thereof, and $R_6$ can be H or Na. Phenols suitable for use in this invention include those sold by Dow Chemical Company under the brand name Dowicide, such as sodium o-phenyl phenol tetrahydrate (Dowicide A), o-phenyl phenol (Dowicide I), 2,4,5 trichloro-phenol (Dowicide II), 2,4,5 trichloro-phenol, sodium salt, ½ hydrate (Dowicide B), and pentachlorophenol (Dowicide EC-7). Further phenols include ortho-benzyl-para-chlorophenol sold under the brand name Santophen I by Monsanto Chemical Corporation.

2. Quaternary Ammonium Compounds:

particular, surprisingly effective antimicrobial compounds suitable for use in this invention are quaternary ammonium compounds.

One would normally expect that quaternary ammonium compounds, some of which are cationic surfactants, having essentially positively charged species in aqueous solution, would react with the anionic surfactants in equilibrium with the acid surfactants disclosed above and cause a precipitate to form. However, the quaternary ammonium compounds used as antimicrobial compounds in this invention are miscible with the mixture of acid surfactant and solvent in the formula and do not precipitate. Instead, a thickening is seen to occur with a preferred percentage of up to 5.0% of quaternary ammonium compound. Surpassing 5.0% has a thixotropic effect on the cleaner, and this latter application may be suitable for use as very substantive cleaners, i.e., bathroom cleaners.

Suitable quaternary ammonium compounds include the dialkyldimethyl ammonium salts of the general structure

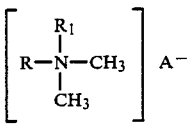

wherein R and $R_1$ are alkyls of $C_5$ to $C_{20}$, and $A^-$ is an acid stable anion. Preferred anions include $Cl^-$, $Br^-$, $I^-$, $SO_4^-$, $ClO_4^-$, $ClO_3^-$, and $NO_3^-$. Other anions stable in the acid surfactants of this invention are possible. $R_1$ can also be an alkyl benzyl group (in which R is a methyl group).

Further particularly preferred are $C_7$ to $C_{12}$ dialkyl dimethyl ammonium salts. Other cationic surfactants, notably other quaternary ammonium salts and tertiary amine surfactants may be suitable for use as disinfectant compounds.

As previously discussed, it is generally unknown why the cationic surfactants used as antimicrobial compounds in this invention are compatible with the acid surfactants. One would normally suspect that the quaternary ammonium compounds would co-precipitate with the anionic form of the acid surfactants. However, a proposed theory, which is not meant herein to be binding, is that these acid surfactants, not being neutralized by an alkali metal salts as the more common anionic surfactants are, may exhibit nonionic moieties in solution which act to solubilize the cationic surfactants (quaternary ammonium compounds) and keep them from precipitating with the anion form of the acidic surfactants herein.

Additionally, the antimicrobial compounds can apparently be used in combination. No loss in stability is seen by combining these two antimicrobial compounds. Further, either or both of these antimicrobial compounds may be present in the invention from approximately 0.001 to 15.0% by weight. Particularly preferred percentages of these antimicrobial compounds are from 0.1-to 10% by weight.

CLEANING ADJUVANTS

Further, approximately 0.0001-25% by weight of further cleaning adjuvants may be added to the present invention. These cleaning adjuvants include thickeners selected from gums, resins and other polysaccharides, such as xanthan gums, starch, and mixtures.

Further cleaning adjuvants include defoamers, such as dialkyl polysiloxane polymers. Particularly preferred as the defomers are those sold by Dow-Corning under the trade name DB 100 for 100% dimethyl polysiloxane. Further defoamers may be applicable for use in this invention, including various cationic and nonionic surfactants.

Still further cleaning adjuvants include dyes, pigments, fragrances and builders. The dyes and pigments in this invention are merely limited to those which will not substantially deposit and stain the surface to be cleaned. Fragrances selected must generally be those which will not be degraded by the low pH of the hard surface acid cleaner. Builders can include many inorganic and organic builders, such as sodium ethylenediaminetetraacetate or HEDTA (hydroxyethyl ethylenediaminetriacetic acid). Further builders include many organic acids and their alkali metal salts, eg., citric acid, sodium citrate, sodium lactate, sodium maleate, etc.

Various formulations of the hard surface acid cleaners of this invention were assayed in the three soiling problem areas: (1) soap scums; (2) hard water stains; and (3) oily/greasy stains, as described in the following section, under "EXPERIMENTAL." Test methodologies and results of assays are set forth in greater detail below.

EXPERIMENTAL

A. Synthetic Soap Scum Test Preparation and Method:

A standard soap scum suspension was prepared using the following ingredients:

| | wt. % |
|---|---|
| Ethyl Alcohol | 85.0% |
| Calcium Stearate | 5.0% |
| Distilled $H_2O$ | 10.0% |
| | 100.0% |

This suspension was applied and baked onto tiles which were then cleaned with various formulations of the hard surface acid cleaner (1) using a Gardner Wear Tester (i.e., "Scrubbing Test") and (2) by a simple application according to the "Soak Test." Impartial panelists were asked to grade the cleaning of the synthetic soap scum stains by the formulations of this invention as well as the performances of competitive cleaners on a 0 to 5 scale, wherein 0=no cleaning, 5=total cleaning. The grading was averaged for a number of trials. These results are reported below in TABLES I, II and III. Competitive products were also tested. Grading was conducted over various time periods to show that the hard surface acid cleaners of this invention clean effectively much more rapidly than competitive products.

B. Hard Water Stain Test Methods:

Two "premixes" were prepared from the following ingredients:

| Premix A | % wt. | Premix B | % wt. |
|---|---|---|---|
| *$Na_2SiO_3X5H_2O$ | 5.0% | Distilled $H_2O$ | 73.0% |
| Distilled $H_2O$ | 95.0% | Ethanol | 24.0% |
| | | Calcium Chloride | 2.0% |
| | | Magnesium Chloride | 1.0% |
| | 100.0% | | 100.0% |

*Metso 20 ® (Trademark, PQ Corporation)

Each premix was sprayed on preheated brown tiles, then baked and allowed to cool.

The tiles were cleaned by applying approximately 4 grams of various formulations of the hard surface said cleaner, scrubbed and rinsed ("Scrubbing Test"). Impartial panelists then graded the cleaning results on a 0 to 5 scale, as previously discussed. Competitive products were also compared. Further, in a second test, "Soak Test," formulations were allowed to soak the target stain for time intervals of 30, 20, 10, 5, 3, and 1 minutes, or 10, 5, 3, 2, 1 minutes and 45 seconds to demonstrate rapid cleaning efficiency. The results are reported in TABLES I, II and IIII below. Participants noted also how quickly effective cleaning occurred at the various time intervals.

C. Oily/Greasy Soil Test Methods

The following oily/greasy soil mixture was prepared:

| | |
|---|---|
| Wilson's Lard | 60.0 grams |
| Wesson Oil | 38.0 grams |
| Grumbacher Cobalt Drier | 2.0 grams |
| (Cobalt Linoleate) | 100.0 grams |

This mixture was applied in a thin layer to precleaned white enamelled metal sheets (which material is the same as used for manufacturing procelain kitchen sinks) and allowed to dry (age) for approximately 24 hours.

Thereafter, each panel was cleaned via the Oil/Grease Stain "Soak Method," wherein approximately 5 grams of various formulations of the hard surface acid cleaner were applied and allowed to soak for time intervals of 30, 20, 10, 5, 3 and 1 minutes. Competitive products were similarly compared. Speed in cleaning, as previously noted, was scrutinized carefully. The results are reported below in TABLES I, II and III below.

TABLE I

Performance[9] of Hard Surface Acid Cleaner versus Competitive Products ("SOAK TEST")

| Example | Formula/ Product Name | % wt. | Soap Scum Test[6] 10 m[10] | 5 m | 3 m | 2 m | 1 m | 45 sec | Oily/Greasy Test[7] 30 m | 20 m | 10 m | 5 m | 3 m | 1 m | Hard Water Stain Test[8] 30 m | 20 m | 10 m | 5 m | 3 m | 1 m |
|---|---|---|---|---|---|---|---|---|---|---|---|---|---|---|---|---|---|---|---|---|
| 1. | 2-Butoxyethanol | 5.0% | 5.0 | 4.9 | 3.8 | 1.9 | 0.7 | 0 | 5.0 | 4.9 | 3.8 | 1.9 | 0.7 | 0 | 3.4 | 3.3 | 3.3 | 3.1 | 3.0 | 2.5 |
| | HLAS[1] | 5.0% | | | | | | | | | | | | | | | | | | |
| | $H_2O$ | 90.0% | | | | | | | | | | | | | | | | | | |
| 2. | Ethanol | 5.0% | 4.9 | 4.4 | 4.1 | 2.8 | 1.6 | 0 | 4.9 | 4.4 | 4.1 | 2.8 | 1.6 | 0 | 3.4 | 3.4 | 3.4 | 3.4 | 3.4 | 2.8 |
| | HLAS[1] | 5.0% | | | | | | | | | | | | | | | | | | |
| | $H_2O$ | 90.0% | | | | | | | | | | | | | | | | | | |
| 3. | DOW DBC[2] | | 4.1 | 2.8 | 1.1 | 0 | 0 | 0 | 4.1 | 2.8 | 1.1 | 0 | 0.1 | 0 | 1.4 | 1.4 | 1.4 | 1.0 | 0.3 | 0 |
| 4. | Lysol[3] | | 1.6 | 1.4 | 1.3 | 1.4 | 0.6 | 0.5 | 1.6 | 1.4 | 1.3 | 1.4 | 0.6 | 0.5 | 1.4 | 1.1 | 1.1 | 0.8 | 0.3 | 0 |
| 5. | Soft Scrub[4] | | 2.0 | 1.0 | 0.5 | 1.0 | 0 | 0 | 2.0 | 1.0 | 0.5 | 1.0 | 0 | 0 | 0 | 0 | 0 | 0 | 0 | 0 |
| 6. | Comet Liquid[5] | | 0.8 | 0.9 | 0 | 0 | 0 | 0 | 0.8 | 0.9 | 0 | 0 | 0 | 0 | 0.5 | 0.5 | 0.1 | 0 | 0 | 0 |

[1]"HLAS" is alkyl benezene sulfonic acid, wherein R averages 10 to 14 carbon atoms.
[2]"DOW DBC" is a trademark of Dow Chemical Company
[3]"Lysol" is a trademark of Lehn and Fink Company
[4]"Soft Scrub" is a trademark of The Clorox Company
[5]"Comet Liquid" is a brand name of Procter and Gamble Company
[6]Soap Scum Test was outlined in "EXPERIMENTAL," "A."
[7]Oily/Greasy Soil Test was outlined in "EXPERIMENTAL," "C."
[8]Hard Water Stain Test was outlined in "EXPERIMENTAL," "B."
[9]Performance was graded by visual assays conducted by impartial panelists on a 0 to 5 scale, wherein 0 = no cleaning, and 5 = total cleaning. The grading was averaged for a number of trials. Test administrators did not disclose or identify what products the panelists were using.
[10]"m" = Minutes.

TABLE II

Performance[6] of Hard Surface Acid Cleaners ("SOAK TEST")

| | Formula/ Product Name | % wt. | Soap Scum Test[3] 30 m[7] | 20 m | 10 m | 5 m | 3 m | 1 m | Oily Greasy Soil Test[4] 30 m | 20 m | 10 m | 5 m | 3 m | 1 m | Hard Water Stain Test[5] 30 m | 20 m | 10 m | 5 m | 3 m | 1 m |
|---|---|---|---|---|---|---|---|---|---|---|---|---|---|---|---|---|---|---|---|---|
| 7. | HLAS[1] | 2% | 4.8 | 4.8 | 4.6 | 3.0 | 2.0 | 0.4 | 5.0 | 3.4 | 3.6 | 3.6 | 1.4 | 0.4 | 1.6 | 1.5 | 1.5 | 1.4 | 1.4 | 1.0 |
| 8. | HLAS | 5% | 5.0 | 5.0 | 5.0 | 5.0 | 5.0 | 4.0 | 5.0 | 5.0 | 5.0 | 5.0 | 4.8 | 0.8 | 3.2 | 3.1 | 3.1 | 2.9 | 2.8 | 2.3 |
| 9. | HLAS | 10% | 5.0 | 5.0 | 5.0 | 4.8 | 5.0 | 4.0 | 5.0 | 4.2 | 5.0 | 4.6 | 4.2 | 4.0 | 4.0 | 3.8 | 3.2 | 3.0 | 3.0 | 3.0 |
| 10. | Dowfax 2AO[2] | 2% | 5.0 | 4.4 | 0.2 | 0.2 | 0.2 | 0.2 | 0.2 | 0.2 | 0 | 0 | 0 | 0 | 0 | 0 | 0 | 0 | 0 | 0 |
| 11. | Dowfax 2AO | 5% | 4.0 | 4.0 | 2.0 | 0.2 | 0.2 | 0.2 | 0.2 | 0.2 | 0.2 | 0.2 | 0.2 | 0.2 | 3.4 | 3.3 | 3.3 | 3.1 | 3.0 | 2.5 |
| 12. | Dowfax 2AO | 10% | 5.0 | 5.0 | 4.8 | 3.4 | 0.4 | 0.2 | 0.4 | 0.2 | 0.2 | 0.2 | 0 | 0 | 4.3 | 4.0 | 4.0 | 3.8 | 3.2 | 3.0 |

[1]"HLAS" is alkyl benzene sulfonic acid, wherein R average 10 to 14 carbon atoms.
[2]"Dowfax 2AO," trademark of DOW Chemical Company, is a diphenyl oxide disulfonate, wherein R = H, and $R_1$ is alkyl of 5 to 20 carbon atoms.
[3]Soap Scum Test was outlined in "EXPERIMENTAL," "A."
[4]Oily/Greasy Soil Test was outlined in "EXPERIMENTAL," "C."
[5]Hard Water Stain Test was outlined in "EXPERIMENTAL," "B."
[6]Performance was graded by visual assays conducted by impartial panelists on a 0 to 5 scale, wherein 0 = no cleaning, and 5 = total cleaning. The grading was averaged for a number of trials. Test administrators did not disclose or identify what products the panelists were using.
[7]"m" = minutes.

TABLE III

Performance[9] of Hard Surface Acid Cleaner Versus Competitive Products ("SCRUBBING TEST")

| Example | Formula | % wt. | Soap Scum Test[7] (Visual Grading) | Hard Water Stain Test[8] (Visual Grading) |
|---|---|---|---|---|
| 13. | 2-Butoxyethanol | 5.0% | 4.8 | 3.7 |
| | HLAS[1] | 5.0% | | |
| | $H_2O$ | 90.0% | | |
| 14. | Ethanol | 5.0% | 4.8 | 3.5 |
| | HLAS[1] | 5.0% | | |
| | $H_2O$ | 90.0% | | |
| 15. | DOW DBC[2] | | 1.9 | 1.3 |
| 16. | Lysol[3] | | 1.1 | 0.9 |
| 17. | Boraxo[4] | | 2.6 | 1.3 |
| 18. | Soft Scrub[5] | | 2.1 | 4.0 |

TABLE III-continued

Performance[9] of Hard Surface Acid Cleaner Versus Competitive Products ("SCRUBBING TEST")

| Example | Formula | % wt. | Soap Scum Test[7] (Visual Grading) | Hard Water Stain Test[8] (Visual Grading) |
|---|---|---|---|---|
| 19. | Comet Liquid[6] | | 3.8 | 2.3 |

[1]HLAS is alkyl benzene sulfonic acid, wherein R averages 10 to 14 carbon atoms.
[2]"DOW DBC" is a trademark of Dow Chemical Company.
[3]"Lysol" is a trademark of Lehn and Fink Company.
[4]"Boraxo" is a trademark of U.S. Borax and Chemical Corporation.
[5]"Soft Scrub" is a trademark of The Clorox Company.
[6]"Comet Liquid" is a trademark of Procter and Gamble Company.
[7]Soap Scum Test was outlined above in "EXPERIMENTAL," "A".
[8]Hard Water Stain Test was outlined above in "EXPERIMENTAL," "B."
[9]Performance was graded by visual assays performed by impartial panelists on a 0 to 5 scale, wherein 0 = no cleaning, and 5 = total cleaning. The grading was averaged for a number of trials. Test administrators did not disclose or identify what products the panelists were using.

In TABLES IV–V, below, the effect of adding a solvent, selected from the preferred solvents discussed previously, to the hard surface acid cleaners of this invention was tested. Surprisingly, it was found that even stronger cleaning performances were obtained without any loss in formula stability.

TABLE IV

Effect of Adding Solvent to the Hard Surface Acid Cleaners ("SOAK TEST")[2,5]

| Example | HLAS[1] | Solvent | Other Additive | Soap Scum Test[3] 30 m | 20 m | 10 m | 5 m | 3 m | 1 m |
|---|---|---|---|---|---|---|---|---|---|
| 20. | 5.0% | 0 | 0 | 5.0 | 4.2 | .3 | 1.6 | .2 | .0 |
| 21. | " | 0 | 6.01% DB-100[4] | 4.8 | 5.0 | 3.6 | 1.8 | 0.4 | 0.4 |
| 22. | " | 5.0% ethanol | 0 | 5.0 | 4.8 | 4.8 | 4.2 | 0.6 | 0.1 |
| 23. | " | 5.0% ethanol | 0.01% DB-100 | 4.6 | 3.8 | 4.4 | 3.8 | 1.4 | 0.2 |
| 24. | " | 5.0% isopropanol | 0 | 5.0 | 5.0 | 4.0 | 3.0 | 1.2 | 0.2 |
| 25. | " | 5.0% isopropanol | 0.01% DB-100 | 4.8 | 4.8 | 4.4 | 0.6 | 0.6 | .0 |
| 26. | " | 5.0% diethyl ether | 0 | 5.0 | 4.0 | 4.0 | 0.4 | 0.2 | 0.2 |

[1]HLAS is alkyl benzene sulfonic acid, wherein R averages 10 to 20 carbon atoms.
[2]"SOAK TEST" was outlined in "EXPERIMENTAL," "A".
[3]"SOAP SCUM TEST" was outlined in "EXPERIMENTAL," "A".
[4]"DB-100" is Dow-Corning's trademark for 100% dimethyl polysiloxane, a defoamer.
[5]Performance was graded by visual assays performed by impartial panelists on a 0 to 5 scale, wherein 0 = no cleaning, and 5 = total cleaning. The grading was averaged for a number of trials. Test administrators did not disclose or identify what products the panelists were using.

TABLE V

Effect of Adding Solvent to the Hard Surface Acid Cleaners ("SOAK TEST")[2,17]

| Example | HLAS[1] | Solvent | Other Additive | Soap Scum Test[3] 10 m | 5 m | 3 m | 2 m | 1 m | 45 Secs. |
|---|---|---|---|---|---|---|---|---|---|
| 27. | 5.0% | 0 | 0 | 4.8 | 4.8 | 3.6 | 3.0 | 0.4 | 0.2 |
| 28. | " | 0 | 0 | 5.0 | 5.0 | 3.2 | 0.4 | 0.2 | 0.2 |
| 29. | " | 0 | 0 | 5.0 | 5.0 | 3.6 | 2.2 | 0.2 | 0.2 |
| 30. | " | 5.0% Dowanol DM[4] | 0 | 5.0 | 4.8 | 4.8 | 4.8 | 2.8 | 0.6 |
| 31. | " | " | 0 | 5.0 | 5.0 | 5.0 | 4.0 | 2.0 | 0.4 |
| 32. | " | 5.0% Dowanol EB[5] | 0 | 5.0 | 5.0 | 4.8 | 4.8 | 0.4 | 0.2 |
| 33. | " | " | 0 | 5.0 | 4.8 | 4.8 | 4.1 | 3.4 | 0.6 |
| 34. | " | 5.0% Dowanol DE[6] | 0 | 5.0 | 5.0 | 5.0 | 3.8 | 0.2 | 0.2 |
| 35. | " | " | 0 | 4.8 | 5.0 | 5.0 | 5.0 | 1.2 | 0.6 |
| 36. | " | 5.0% Dowanol EM[7] | 0 | 4.8 | 5.0 | 3.4 | 2.0 | 0.2 | 0.2 |
| 37. | " | " | 0 | 4.8 | 4.8 | 4.4 | 3.6 | 0.8 | 0.2 |
| 38. | " | 5.0% Dowanol TPM[8] | 0 | 5.0 | 5.0 | 4.8 | 4.8 | 0.2 | 0.2 |
| 39. | " | " | 0 | 4.8 | 4.8 | 2.8 | 0.2 | 0 | 0 |
| 40. | " | 5.0% Dowanol DB[9] | 0 | 4.8 | 5.0 | 4.8 | 4.8 | 0.2 | 0.2 |
| 41. | " | " | 0 | 5.0 | 5.0 | 4.8 | 4.6 | 2.6 | 1.2 |
| 42. | " | 5.0% Dowanol EE[10] | 0 | 4.8 | 5.0 | 4.0 | 4.0 | 1.2 | 0.2 |
| 43. | " | " | 0 | 5.0 | 5.0 | 4.8 | 3.8 | 0.8 | 0.8 |
| 44. | " | 5.0% Dowanol PiPT[11] | 0 | 5.0 | 4.0 | 0.2 | 0.2 | 0.2 | 0.2 |
| 45. | " | " | 0 | 5.0 | 4.4 | 3.8 | 1.6 | 0 | 0.4 |
| 46. | " | 5.0% Dowanol DPM[12] | 0 | 5.0 | 5.0 | 5.0 | 4.0 | 0.2 | 0.4 |
| 47. | " | " | 0 | 5.0 | 5.0 | 3.8 | 2.2 | 0 | 0 |
| 48. | " | 5.0% Dowanol DPM[12] | 5.0% IPA[16] | 5.0 | 5.0 | 5.0 | 3.2 | 0.2 | 0.2 |

TABLE V-continued

Effect of Adding Solvent to the Hard Surface Acid Cleaners ("SOAK TEST")[2,17]

| Example | HLAS[1] | Solvent | Other Additive | Soap Scum Test[3] 10 m | 5 m | 3 m | 2 m | 1 m | 45 Secs. |
|---|---|---|---|---|---|---|---|---|---|
| 49. | " | " | " | 5.0 | 4.6 | 5.0 | 4.6 | 2.8 | 0.4 |
| 50. | " | 5.0% Dowanol PM[13] | 0 | 4.8 | 3.8 | 4.8 | 2.2 | 1.0 | 0.2 |
| 51. | " | " | 0 | 4.8 | 4.8 | 3.8 | 2.2 | 0.2 | 0 |
| 52. | " | 5.0% Dowanol EPH[14] | 0 | 5.0 | 5.0 | 0.2 | 3.0 | 2.0 | 0 |
| 53. | " | " | 0 | 5.0 | 5.0 | 5.0 | 3.6 | 0.6 | 0.4 |
| 54. | " | 5.0% Butyl Oxitol[15] | 0 | 5.0 | 5.0 | 5.0 | 5.0 | 4.4 | 3.2 |
| 55. | " | " | 0 | 5.0 | 5.0 | 5.0 | 5.0 | 3.4 | 2.4 |

[1]HLAS is alkyl benzene sulfonic acid, wherein R averages 10 to 14 carbon atoms.
[2]"Soak Test" was outlined in "EXPERIMENTAL," "A" above.
[3]"Soap Scum Test" was outlined in "EXPERIMENTAL," "A" above.
[4]"Dowanol DM" is Dow Chemical Company's trademark for diethylene glycol methyl ether ($CH_3OC_2H_4OC_2H_4OH$)
[5]"Dowanol EB" is Dow Chemical Company's trademark for ethylene glycol N—butyl ether ($C_4H_9OC_2H_4OH$)
[6]"Dowanol DE" is Dow Chemical Company's trademark for diethylene glycol ethyl ether ($C_2H_5OC_2H_4C_2H_4OH$)
[7]"Dowanol EM" is Dow Chemical Company's trademark for ethylene glycol methyl ether ($CH_3OC_2H_4OH$)
[8]"Dowanol TPM" is Dow Chemical Company's trademark for tripropylene glycol methyl ether ($CH_3O[CH_2CH(CH_3)O]_3H$)
[9]"Dowanol DB" is Dow Chemical Company's trademark for diethylene glycol N—butyl ether ($C_4H_9OC_2H_4OC_2H_4OH$
[10]"Dowanol EE" is Dow Chemical Company's trademark for ethylene glycol ethyl ether ($C_2H_5OC_2H_4OH$)
[11]"Dowanol PiBT" is Dow Chemical Company's trademark for propylene glycol isobutyl ether ($(CH_3)_2C_2H_3OCH_2CHOHCH_3$)
[12]"Dowanol DPM" is Dow Chemical Company's trademark for dipropylene glycol methyl ether ($CH_3O[CH_2CH(CH_3)O]_2H$)
[13]"Dowanol PM" is Dow Chemical Company's trademark for propylene glycol methyl ether ($CH_3OCH_2CHOHCH_3$)
[14]"Dowanol EPH" is Dow Chemical Company's trademark for ethylene glycol phenyl ether ($C_6H_5OC_2H_4OH$)
[15]"Butyl Oxitol" is Shell Chemical Company's trademark for ethylene glycol monobutyl ether ($C_4H_9OC_2H_4OH$)
[16]"IPA" is isopropyl alcohol (2-propanol)
[17]Performance was graded by visual assays performed by impartial panelists on a 0 to 5 scale, wherein 0 = no cleaning and 5 = total cleaning. The grading was averaged for a number of trials. Test administrators did not disclose or identify that products the panelists were using.

TABLE VI, below, illustrates the effect of adding a germicidal compound to the hard surface acid cleaners of this invention. As previously discussed, the preferred germicidal or antimicrobial compounds are chosen from substituted phenols, quaternary ammonium compounds, or mixtures thereof. Surprisingly, not only were the phenols stably miscible with the hard surface acid cleaners, but the quaternary ammonium compounds as well. Since the quaternary ammonium compounds are cationic species, i.e., positively charged species in aqueous solutions, it was presumed that precipitation would occur upon combination with the acid surfactants of the present invention. Surprisingly, no precipitation occurred, and the quaternary ammonium compounds also caused a thickening of the formulas when used in percentages of 5.0% or more. Adding more than 5.0% may cause a thixotrope to form, which helps the cleaning formula stay in place when applied to a vertical surface. This is a substantial benefit over other cleaners which are not as substantive and which tend to drain off. Furthermore, as disclosed in TABLE VI below, the antimicrobial activity of the antimicrobial compounds was very efficacious.

TABLE VI

Effect of Adding an Antimicrobial Compound to the Hard Surface Acid Cleaners

| Example | Formula | Antimicrobial Action Against: Gram Positive[4] Bacteria | Gram Negative[5] Bacteria | Fungus[6] |
|---|---|---|---|---|
| 56. | (Control) | No effect | No effect | No effect |
| 57. | HLAS 5.0%<br>Ethanol 5.0%<br>Xanthan Gum 0.1%<br>Bardac 22[3] 0.25% | Both fresh and 60 day aged samples effective | Both fresh and 60 day aged samples effective | Fresh samples effective |
| 58. | HLAS 5.0%<br>Ethanol 5.0%<br>Xanthan Gum[6] 0.1%<br>Santophen 1[3] 0.25% | Both fresh and 60 day aged samples effective | Both fresh and 60 day aged samples effective | Fresh samples effective |
| 59. | HLAS 5.0%<br>Ethanol 5.0%<br>Xanthan Gum 0.1%<br>Bardac 22[2] 0.125%<br>Santophen 1[3] 0.125% | Both fresh and 60 day aged samples effective | Both fresh and 60 day aged samples effective | Fresh samples effective |
| 60. | HLAS 5.0%<br>2-Butoxyethanol 5.0%<br>Xanthan Gum 0.1% | Both fresh and 60 day aged samples | Both fresh and 60 day aged samples | Fresh samples effective |

TABLE VI-continued

Effect of Adding an Antimicrobial Compound to the Hard Surface Acid Cleaners

| Example | Formula | Antimicrobial Action Against: Gram Positive[4] Bacteria | Gram Negative[5] Bacteria | Fungus[6] |
|---|---|---|---|---|
| | Santophen 1[3] 0.25% | effective | effective | |

[1](Control) = 5.0% HLAS, 5.0% ethanol, and 0.1% xanthan gum. Xanthan gum is a thickener compatible with the acid surfactants of this invention

[2]Bardac 22, a trademark of Lonza Chemical Company, is a quaternary ammonium compound with the following structure:

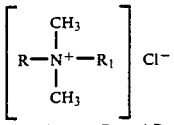

wherein R = $R_1$ and R averages 10 carbon atoms in length.

[3]Santophen 1, a trademark of Monsanto Chemical Company, is a phenolic compound with the following structure:

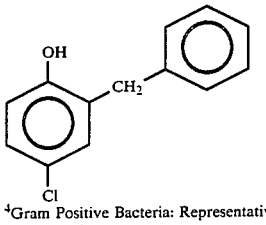

[4]Gram Positive Bacteria: Representative examples include Bacillus sp., Lactobacillus sp., Streptococcus sp., Staphylococcus sp., etc.

[5]Gram Negative Bacteria: Representative examples include *Escherichia coli*, Salmonella sp., Proteus sp., etc.

[6]Fungus: Representative examples include *Trichophyton mentagrophytes*, *Tinea pedis* (mostly Athlete's Foot fungi), etc.

Review of TABLES I–VI shows that the hard surface acid cleaners of the present invention show surprising efficacy and fast action.

In direct comparison tests with other commercially available cleaners in TABLES I, II and III, the hard surface acid cleaners showed that total cleaning was consistently achieved, whether a "Scrubbing Test" or "Soak Test" was considered, and cleaning results were achieved faster than when using any of the competitive products. TABLES IV–V disclosed the even greater cleaning efficiency when using a variety of different solvents of varying structures. Further, using more than one type of solvent as in Example 48 is possible, but in the interest of cost effectiveness may not be as desirable, although such increases still constitute a part of this invention. Lastly, TABLE VI shows that effective antimicrobial action is obtained by adding either a substituted phenol, a quaternary ammonium compound, or both, with surprisingly no loss in stability from addition of the quaternary ammonium compound.

The present invention therefore provides a multipurpose, fast acting and effective hard surface acid cleaner which is effective over the three major problem cleaning areas.

What is claimed is:

1. An all purpose hard surface acid cleaner consisting essentially of:

(a) about 1.0% to 30.0% by weight of an acid surfactant providing the sole source of acidity and surfactancy to the cleaner, said acid surfactant being selected from alkyl benzene sulfonic acids having an alkyl group averaging 5 to 20 carbon atoms; alkylated diphenyl oxide disulfonates having an alkyl group averaging 5 to 20 carbons; and mixtures thereof;

(b) about 0.1 to 15% by weight of an organic solvent selected from straight chain, primary, secondary and tertiary $C_{1-10}$ alkanols, $C_{5-10}$ alicyclic alkanols, $C_{2-8}$ dialkyl ethers, $C_{3-20}$ glycol ethers, and mixtures thereof;

(c) 0.1 to 10% of a quaternary ammonium compound used as an anti-microbial agent, said compound having the structure

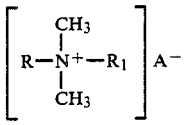

wherein R and $R_1$ are alkyls of $C_5$ to $C_{20}$, aryls of $C_6$ to $C_{20}$, or alkylaryls of $C_7$ to $C_{20}$; and $A^-$ is an acid stable anion; said anti-microbial agent present in an amount which does not co-precipitate with the acid surfactant; and (d) the remainder, water.

2. The cleaner of claim 1 wherein said acid surfactant is $C_{5-20}$ alkyl benzene sulfonic acid.

3. The cleaner of claim 1 further comprising 0.001 to 15.0% by weight of (e) a further antimicrobial compound which is a substituted phenol of the general structure

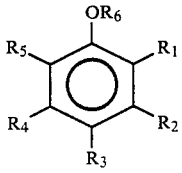

wherein $R_1$, $R_2$, $R_3$, $R_4$, $R_5$ can be phenyl, substituted phenyl, Cl, or H; and $R_6$ is H or Na.

4. The cleaner of claim 3 further comprising (f) a thickener selected from gums, resins, polysaccharides, and mixtures thereof.

* * * * *